US009850672B2

(12) United States Patent
Kumar et al.

(10) Patent No.: US 9,850,672 B2
(45) Date of Patent: Dec. 26, 2017

(54) ALTERNATING PADDLE MECHANISM FOR POOL CLEANER

(71) Applicants: Satheesh Kumar, Nagapattinam (IN); Narendra Pratap Singh, Uttar Pradesh (IN); Suresh C. Gopalan, Milpitas, NC (US)

(72) Inventors: Satheesh Kumar, Nagapattinam (IN); Narendra Pratap Singh, Uttar Pradesh (IN); Suresh C. Gopalan, Milpitas, NC (US)

(73) Assignee: Pentair Water Pool and Spa, Inc., Cary, NC (US)

( * ) Notice: Subject to any disclaimer, the term of this patent is extended or adjusted under 35 U.S.C. 154(b) by 713 days.

(21) Appl. No.: 14/209,876

(22) Filed: Mar. 13, 2014

(65) Prior Publication Data

US 2014/0271175 A1 Sep. 18, 2014

Related U.S. Application Data

(60) Provisional application No. 61/780,481, filed on Mar. 13, 2013.

(51) Int. Cl.
*F03B 3/12* (2006.01)
*E04H 4/16* (2006.01)

(52) U.S. Cl.
CPC ..... *E04H 4/16* (2013.01); *E04H 4/1654* (2013.01)

(58) Field of Classification Search
CPC ... F03B 3/12; F03B 3/121; E04H 4/16; E04H 4/1645; E04H 4/1654; E04H 4/1672; F05D 2240/30; F05D 2240/307
USPC ..... 416/203, 228, 240; 290/43, 54
See application file for complete search history.

(56) References Cited

U.S. PATENT DOCUMENTS 1,200,308 A 10/1916 Bunnell
2,007,963 A * 7/1935 Cleveland ..... F03D 3/065 416/132 B
3,439,368 A 4/1969 Myers
3,551,930 A 1/1971 Myers
3,860,518 A 1/1975 Henricksen
3,921,654 A 11/1975 Pansini
(Continued)

FOREIGN PATENT DOCUMENTS

AU 7241884 7/1982
ES 2374887 A 2/2012
(Continued)

*Primary Examiner* — Woody Lee, Jr.
*Assistant Examiner* — Jesse Prager
(74) *Attorney, Agent, or Firm* — Quarles & Brady LLP

(57) ABSTRACT

Embodiments of the invention provide a paddle wheel mechanism for a pool cleaner. The paddle wheel mechanism includes a housing with an internal flow area, a paddle wheel shaft supported by the housing, and a paddle wheel supported by the paddle wheel shaft. The paddle wheel includes a base extending along a base width and a plurality of paddle wheel blades extending from the base within the internal flow area. The plurality of paddle wheel blades include a first-type blade with a first blade portion having a first blade width, and a second-type blade with a second blade portion having a second blade width. The first blade width and the second blade width are each less than the base width, and the first-type and second-type blades are arranged on the base in an alternating manner.

20 Claims, 5 Drawing Sheets

(56) References Cited

U.S. PATENT DOCUMENTS

| | | | | |
|---|---|---|---|---|
| 3,979,788 | A | 9/1976 | Strausak | |
| 4,007,996 | A | 2/1977 | Boone | |
| 4,177,009 | A | 12/1979 | Baum et al. | |
| 4,536,908 | A | 8/1985 | Raubenheimer | |
| 4,718,613 | A | 1/1988 | Moomaw | |
| 4,722,110 | A | 2/1988 | Chandler | |
| 4,789,364 | A | 12/1988 | Chauvier et al. | |
| 4,835,810 | A | 6/1989 | Hugo | |
| 5,001,800 | A | 3/1991 | Parenti et al. | |
| 5,002,461 | A | 3/1991 | Young et al. | |
| 5,105,496 | A | 4/1992 | Gray et al. | |
| 5,412,826 | A | 5/1995 | Raubenheimer | |
| 5,435,031 | A | 7/1995 | Minami et al. | |
| 5,507,058 | A | 4/1996 | Minami et al. | |
| 5,584,656 | A | 12/1996 | Rose | |
| 5,617,600 | A | 4/1997 | Frattini | |
| 5,771,987 | A | 6/1998 | Marbach | |
| 5,797,156 | A | 8/1998 | Sebor | |
| 5,933,899 | A | 8/1999 | Campbell et al. | |
| D417,047 | S | 11/1999 | Tsuda | |
| 5,985,156 | A | 11/1999 | Henkin et al. | |
| 6,039,886 | A | 3/2000 | Henkin et al. | |
| 6,094,764 | A | 8/2000 | Veloskey et al. | |
| 6,115,864 | A | 9/2000 | Davidsson et al. | |
| 6,212,725 | B1 | 4/2001 | Porat | |
| D444,280 | S | 6/2001 | Rief et al. | |
| 6,280,611 | B1 | 8/2001 | Henkin et al. | |
| 6,292,970 | B1 * | 9/2001 | Rief | E04H 4/1654 15/1.7 |
| 6,365,039 | B1 | 4/2002 | Henkin et al. | |
| 6,665,900 | B2 * | 12/2003 | Wichmann | E04H 4/1672 15/1.7 |
| RE38,479 | E | 3/2004 | Henkin et al. | |
| 6,782,578 | B1 | 8/2004 | Rief et al. | |
| 6,854,148 | B1 | 2/2005 | Rief et al. | |
| 7,039,980 | B2 | 5/2006 | Van Der Meyden et al. | |
| D529,669 | S | 10/2006 | Blanc-Tailleur | |
| 7,117,554 | B2 | 10/2006 | Pichon | |
| 7,162,763 | B2 | 1/2007 | Henkin et al. | |
| 7,201,563 | B2 | 4/2007 | Studebaker | |
| 7,243,389 | B2 | 7/2007 | Phillipson | |
| 7,293,314 | B2 | 11/2007 | Henkin et al. | |
| D575,915 | S | 8/2008 | Dreyer | |
| 7,464,429 | B2 | 12/2008 | Stoltz | |
| 7,520,282 | B2 | 4/2009 | Stoltz | |
| D598,168 | S | 8/2009 | Sumonthee | |
| D599,967 | S | 9/2009 | Blanc-Tailleur | |
| 7,736,523 | B2 | 6/2010 | King | |
| 7,765,639 | B2 | 8/2010 | Lee et al. | |
| 7,849,547 | B2 | 12/2010 | Erlich et al. | |
| 8,117,704 | B2 | 2/2012 | Schneider et al. | |
| D670,459 | S | 11/2012 | Mastio et al. | |
| D670,460 | S | 11/2012 | Mastio et al. | |
| D670,461 | S | 11/2012 | Mastio et al. | |
| D670,462 | S | 11/2012 | Mastio et al. | |
| D670,463 | S | 11/2012 | Mastio et al. | |
| D670,464 | S | 11/2012 | Mastio et al. | |
| D670,465 | S | 11/2012 | Mastio et al. | |
| 8,307,485 | B2 | 11/2012 | Sumonthee | |
| 8,397,330 | B2 | 3/2013 | Pichon et al. | |
| 8,402,585 | B2 | 3/2013 | Rief et al. | |
| 8,402,586 | B2 | 3/2013 | Lavabre | |
| 8,424,142 | B2 | 4/2013 | Garti | |
| D684,738 | S | 6/2013 | Richiuso et al. | |
| 8,505,143 | B2 | 8/2013 | Finezilber | |
| 8,510,889 | B2 | 8/2013 | Hui et al. | |
| 8,595,880 | B2 | 12/2013 | Pichon et al. | |
| 2005/0126969 | A1 | 6/2005 | Dolton | |
| 2008/0125943 | A1 | 5/2008 | Finezilber | |
| 2008/0128343 | A1 | 6/2008 | Garti | |
| 2009/0300862 | A1 | 12/2009 | Schneider et al. | |
| 2009/0307854 | A1 | 12/2009 | Garti | |
| 2010/0119358 | A1 | 5/2010 | Van Der Meijden et al. | |
| 2011/0154585 | A1 | 6/2011 | Mastio et al. | |
| 2011/0162683 | A1 | 7/2011 | Mastio et al. | |
| 2011/0301752 | A1 | 12/2011 | Finezilber | |
| 2012/0060307 | A1 | 3/2012 | Stoltz | |
| 2012/0144605 | A1 | 6/2012 | Dewings | |
| 2012/0174326 | A1 | 7/2012 | Finezilber | |
| 2012/0210527 | A1 | 8/2012 | Erlich et al. | |
| 2012/0285486 | A1 | 11/2012 | Erlich et al. | |
| 2013/0081216 | A1 | 4/2013 | Gopalan et al. | |
| 2013/0091641 | A1 | 4/2013 | Ben Zion | |
| 2013/0133145 | A1 | 5/2013 | Pichon et al. | |
| 2013/0152316 | A1 | 6/2013 | Rief et al. | |
| 2014/0251038 | A1 * | 9/2014 | Kumar | E04H 4/1654 74/55 |

FOREIGN PATENT DOCUMENTS

| | | | |
|---|---|---|---|
| WO | 9002265 | A1 | 3/1990 |
| WO | 2011100067 | A1 | 8/2011 |

* cited by examiner

ALTERNATING PADDLE MECHANISM FOR POOL CLEANER

CROSS REFERENCE TO RELATED APPLICATIONS

This application claims the benefit of U.S. Provisional Patent Application No. 61/780,481 filed on Mar. 13, 2013, the entire contents of which are incorporated herein by reference.

BACKGROUND

Mechanical pool cleaners are typically classified as pressure-side cleaners or suction-side cleaners based on their connection to a pool pump. More specifically, suction-side pool cleaners are connected to a suction or inlet port of the pump, while pressure-side pool cleaners are connected to a pressure or outlet port of the pump. In both types, water is drawn or forced through the cleaner and mechanisms are provided to attempt to harvest energy from water movement through the cleaner in order to operate one or more functions of the cleaner (e.g., vacuuming, steering, etc.).

With respect to suction-side pool cleaners, a turbine or paddle wheel may be provided within a water flow passage to harvest energy from the water flow. Generally, design aspects of the paddle wheel are based on a tradeoff between performance and efficiency. For example, reducing the clearances between blades of the paddle wheel and the walls of the flow passage may increase efficiency by allowing the paddle wheel to harness more kinetic energy from the fluid flow. However, reduced clearance may detrimentally affect paddle wheel performance because debris may not be allowed to pass through the water flow passage, and/or may impede rotation of the paddle wheel. On the other hand, increasing the clearances may improve performance by allowing debris to pass through the passage without impeding the paddle wheel. In this instance, however, more fluid may flow through the larger clearances without providing kinetic energy to the paddle wheel, which may result in reduced efficiency.

One known pool cleaning system includes a number of paddle wheel blades that are pivotably mounted to the paddle wheel. When the blades pivot with respect to the paddle wheel, the clearance between the blades and the housing in which they rotate may change, which may allow larger debris to pass between the blades and the housing. The use of pivoting blades, however, may contribute to increased drag or reduced efficiency, or may increase the complexity of manufacturing or assembly of the cleaning system.

Another known pool cleaning system includes a paddle having a number of blades that collectively revolve around a central axis, but are each mounted, independently, on a rotating shaft extending radially outward from the central axis. The separate rotating shafts allow the individual blades to pivot with respect to their bulk movement around the central axis, which may allow debris to move past the individual blades. Such an arrangement, however, may significantly increase the complexity of manufacturing and assembly of the cleaning system, and may also decrease overall efficiency.

Therefore, it would be desirable to provide a pool cleaner that addresses one or more of the above deficiencies. For example, it would be desirable to have a pool cleaner with a paddle wheel mechanism that allows debris to pass in a manner that does not clog or otherwise obstruct the pool cleaner, while also providing an efficient pool cleaner with relatively low complexity of manufacturing, assembly, or maintenance.

SUMMARY

Some embodiments provide a pool cleaner including a turbine paddle wheel with paddle wheel blades that are offset from each other in an alternating manner. Debris in the fluid flow is able to pass the paddle wheel without excessively choking or clogging the paddle wheel while still efficiently utilizing kinetic energy from the fluid flow.

Other embodiments provide a paddle wheel mechanism for a pool cleaner. The paddle wheel mechanism includes a housing with an internal flow area, a paddle wheel shaft supported by the housing, and a paddle wheel supported by the paddle wheel shaft. The paddle wheel includes a paddle wheel base extending along a base width and a plurality of paddle wheel blades extending from the paddle wheel base within the internal flow area. The plurality of paddle wheel blades each include a first-type blade with a first blade portion having a first blade width extending along the paddle wheel base from a first side of the paddle wheel base. The plurality of paddle wheel blades also each include a second-type blade with a second blade portion having a second blade width extending along the paddle wheel base from a second side of the paddle wheel base. The first blade width and the second blade width are each less than the base width of the paddle wheel base and the first-type blade and the second-type blade are arranged on the paddle wheel base in an alternating manner.

Some embodiments provide another paddle wheel mechanism for a pool cleaner. The paddle wheel mechanism includes a housing with an internal cavity for fluid flow, a paddle wheel shaft supported by the housing and extending across the internal cavity, and a paddle wheel supported by the paddle wheel shaft. The paddle wheel includes a paddle wheel base extending along a base width and a plurality of paddle wheel blades extending radially from the paddle wheel base within the internal cavity. The plurality of paddle wheel blades include a plurality of first-type blades, each with a first blade portion having a first blade width extending axially along the paddle wheel base from a first side of the internal cavity. The plurality of paddle wheel blades also include a plurality of second-type blades, each with a second blade portion having a second blade width extending axially along the paddle wheel base from a second side of the internal cavity. The first blade width and the second blade width are each less than the base width of the paddle wheel base and the first-type blades and the second-type blades are arranged on the paddle wheel base in an alternating manner.

DETAILED DESCRIPTION

Figure 1B:
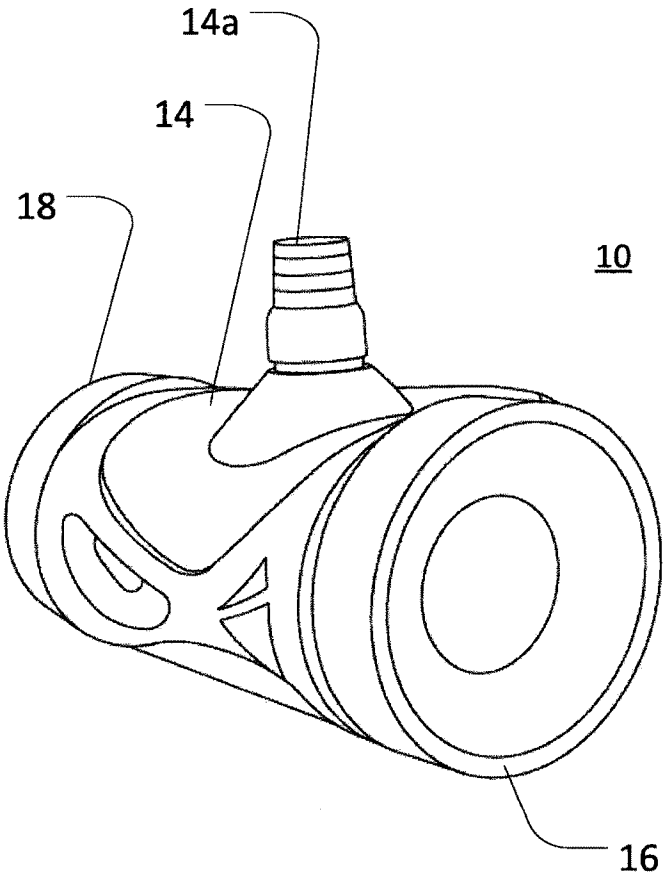
FIGS. 1A and 1B are isometric views of a pool cleaner for use with a paddle mechanism.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Various types of suction-side (or other) swimming pool cleaners are operated using energy harvested from the flow of fluid drawn through them. More specifically, suction-side pool cleaners are connected to a suction side of a pool pump that causes fluid to be drawn along a fluid path within the pool cleaner. A paddle wheel mechanism positioned within the fluid path may accordingly be utilized to harvest energy from the fluid flow along the fluid path.

As noted above, it may be useful to provide a paddle wheel mechanism that balances concerns of efficiency with other performance considerations. For example, it may be useful to provide a paddle wheel mechanism that harnesses kinetic energy from a fluid flow with relatively high efficiency, while also preventing debris from excessively interfering with performance of the system. In certain embodiments, such a paddle wheel mechanism may include a paddle wheel with two different types of paddle wheel blades arranged in an alternating fashion around the wheel. For example, one type of paddle wheel blade may extend from a first side of a paddle wheel base (and a first side of the cavity in which the paddle wheel is housed) part, but not all, of the way toward the other (second) side of the paddle wheel base (and the other side of the cavity in which the paddle wheel is housed). In contrast, another type of paddle wheel blade may extend from the other (second) side of the paddle wheel base part, but not all, of the way toward the first side of the paddle wheel base. With these two blade types arranged in an alternating configuration around the paddle wheel, the blades may accordingly harvest a substantial portion of kinetic energy of a fluid flow across the paddle wheel, while at the same time still providing a path for debris to travel past the paddle wheel without becoming lodged on the wheel or otherwise impeding its rotation (i.e., a path traveling toward the second side of the paddle wheel base to clear the first-type blade, back toward the first side of the paddle wheel base to clear the second-type blade, and so on).

Figure 1A:
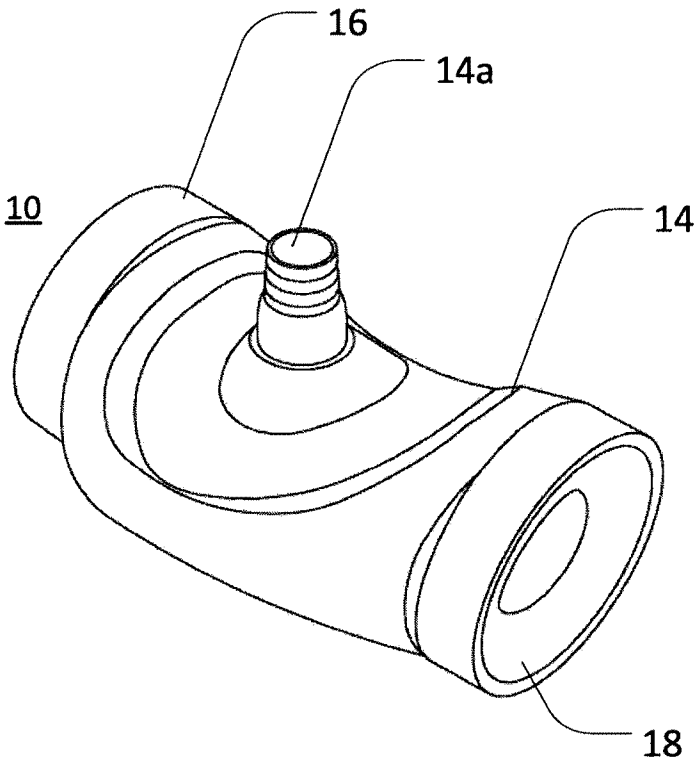

Referring now to FIG. 1, an example pool cleaner 10 is depicted, which may utilize a paddle wheel mechanism 12 (see, e.g., FIG. 2) to harvest kinetic energy of fluid moving through the pool cleaner 10. The pool cleaner 10 may be configured as a suction-side pool cleaner, or as various other types of pool cleaners (e.g., a pressure-side pool cleaner) known in the art. The pool cleaner 10 generally includes a housing 14, which is designed to retain a paddle wheel mechanism 12. The pool cleaner 10 further includes in an inlet (not shown) disposed on a lower surface of the pool cleaner that allows for fluid and debris to enter into the pool cleaner 10. The pool cleaner 10 also includes an outlet 14*a* provided in the form of a cylindrical connection extending from an upper portion of the housing 14, which is designed to interact with a hose (not shown) that transports debris and/or water to a pool filtering mechanism and/or collection device. In certain embodiments, a paddle wheel mechanism 12 may provide kinetic energy for the wheels 16 and 18, or for various other features of components.

Figure 2:
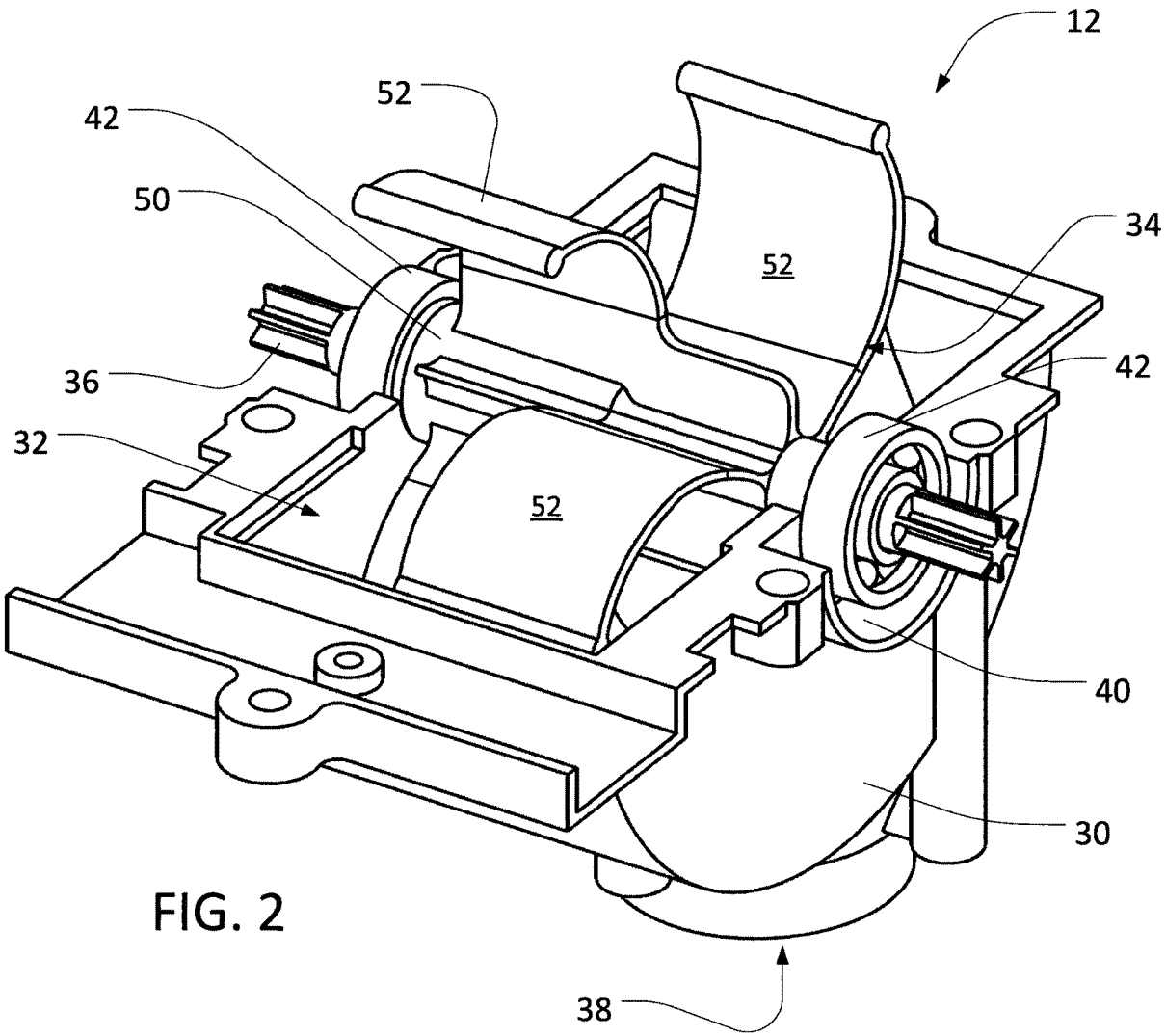
FIG. 2 is an isometric view of an example paddle wheel mechanism for the pool cleaner of FIGS. 1A and 1B.
Figure 3:
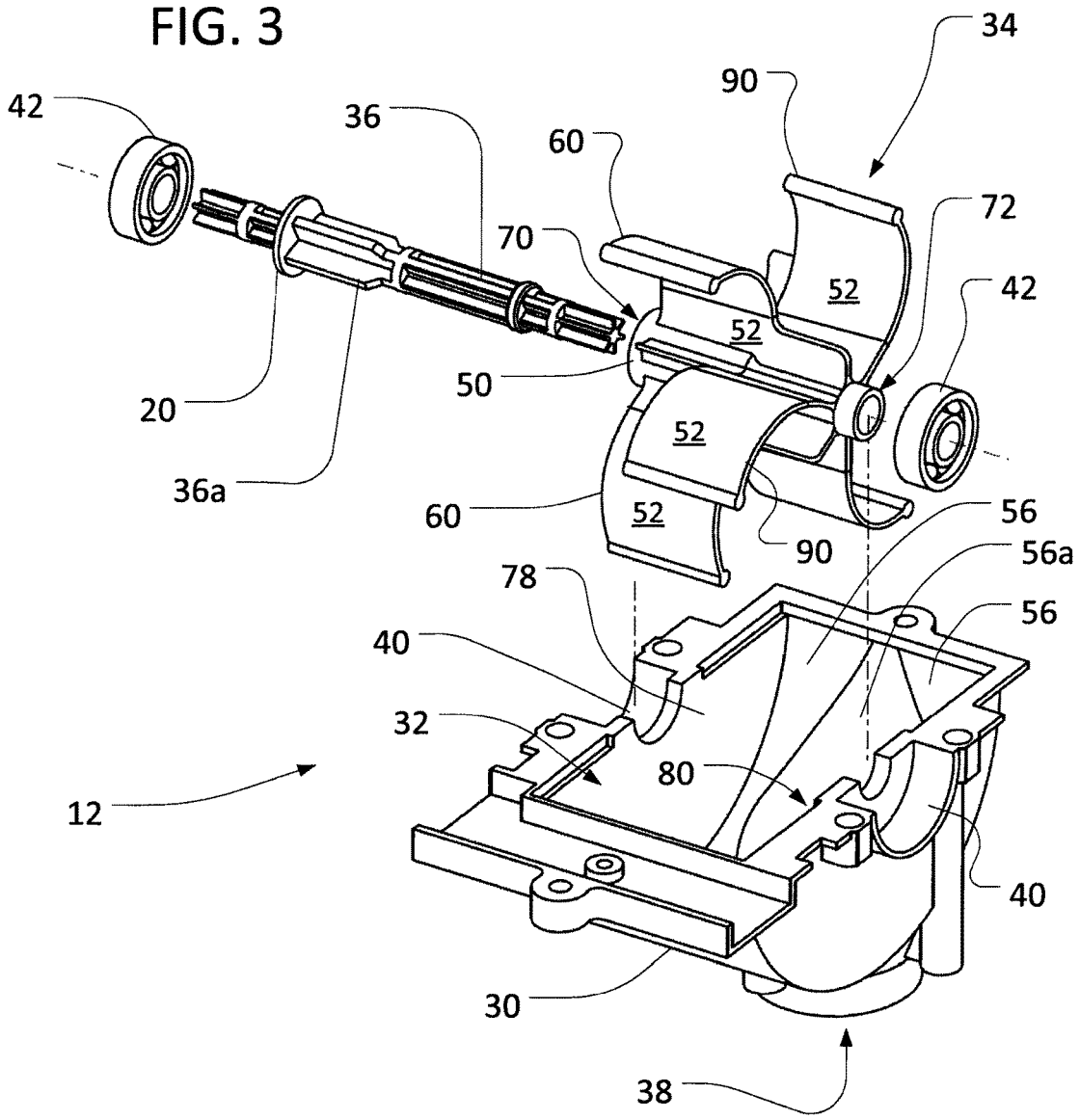
FIG. 3 is an exploded isometric view of the paddle wheel mechanism of FIG. 2.

Referring also to FIGS. 2 and 3, paddle wheel mechanism 12 is depicted, for optimizing debris handling and energy harvesting within the suction-side swimming pool cleaner 10. The paddle wheel mechanism 12 includes a paddle wheel housing 30 (shown with an upper housing portion removed), and a paddle wheel 34 supported by a paddle wheel shaft 36. The housing 30 defines an internal paddle wheel cavity 32 surrounding the paddle wheel 34, and includes an inlet fluid path opening 38, and an outlet fluid path opening (not shown) on the opposing side of the paddle wheel 34 from the opening 38. During operation of the cleaner 10, accordingly, fluid may flow into the cavity 32 via the opening 38 and out of the cavity 32 via the outlet opening (not shown), such that the cavity 32 defines, at least in part, an internal fluid flow area for housing 30.

As shown in FIG. 3, the housing 30 also includes shaft supports 40, each of which receive a shaft bearing 42 through which the paddle wheel shaft 36 extends. The shaft bearings 42 accordingly allow the paddle wheel shaft 36, and thus the paddle wheel 34, to rotate freely within the cavity 32 of the housing 30. It will be understood, that in other embodiments, the paddle wheel 34 may be mounted within the housing 30 for rotation in a variety of other known ways. For example, the shaft 36 may be rotatably mounted directly to the housing 30, may be fixedly mounted to the housing 30 with the paddle wheel 34 rotating around the shaft 36, or may extend through the housing 30 to mounting points removed from the housing 30. Similarly, the shaft 36 may be a single-body shaft, may include two half-shafts, or may take a variety of other configurations.

The cavity 32 of the housing 30 is defined, at least in part, by a curved inner surface 56, which may be designed to generally provide relatively small clearance for the rotation of paddle wheel 34. For example, the inner surface 56 may be generally curved to follow the path traced by the radially outermost (or other) portions of the blades 52 of the paddle wheel 34 (as discussed in greater detail below), the inner surface 56 generally defining a relatively small clearance between those outermost blade (or other) portions and the surface 56. In certain embodiments, relatively larger clearance may be provided for paddle wheel 34 over a surface portion 56*a* corresponding, for example, to a region in which fluid flows from the opening 38 into the cavity 34. The cavity 34 is also defined by internal surfaces (e.g., side walls) 78 and 80, which may be designed to provide relatively small clearances between lateral features of the paddle wheel 34 (e.g., sides 70 and 72 of paddle wheel base 50), lateral edges of blades of the paddle wheel 34, or other components (e.g., a flange 20 on the paddle wheel shaft 36).

Figure 4:
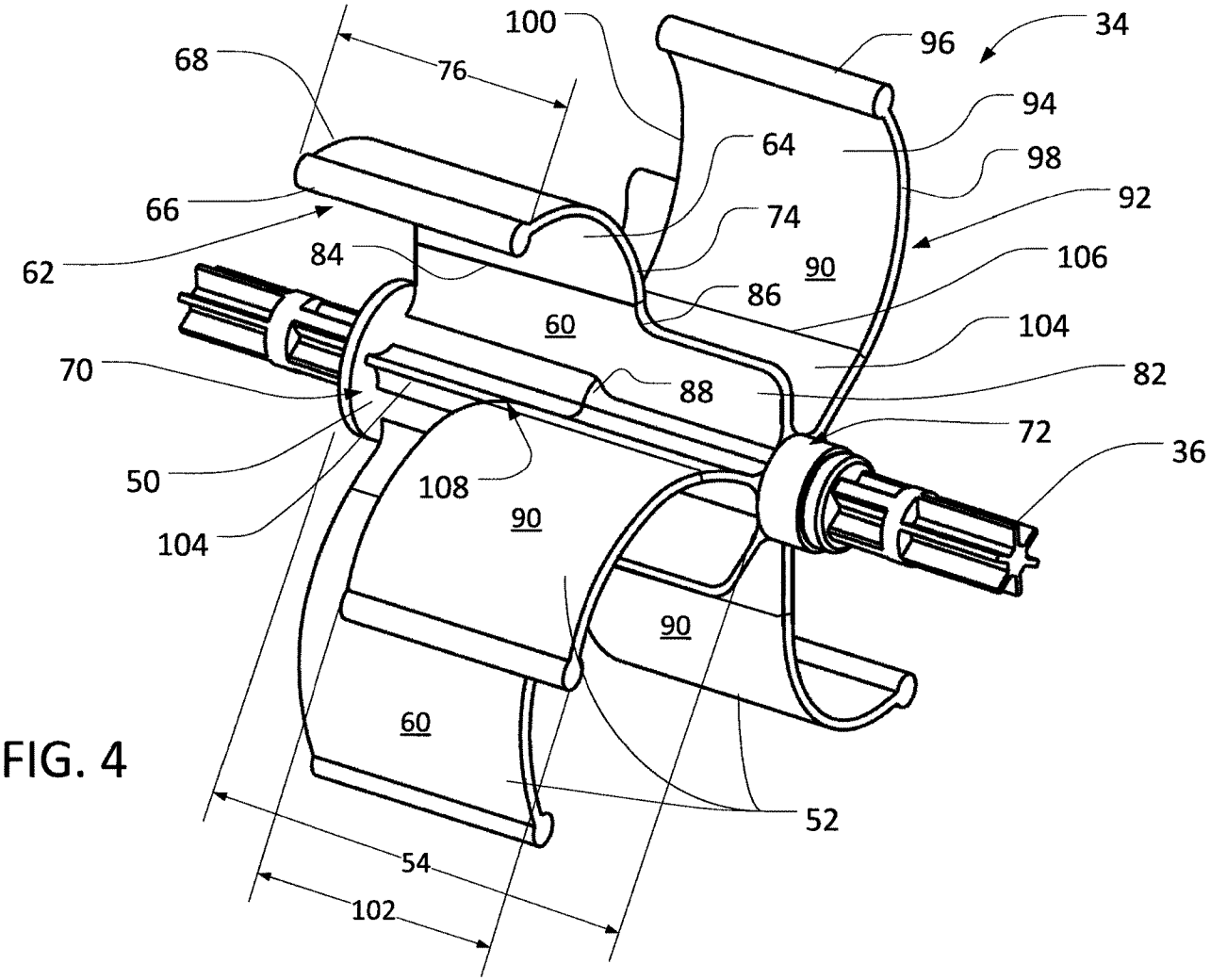
FIG. 4 is an isometric view of a paddle wheel and a paddle wheel shaft of the paddle wheel mechanism of FIG. 2.

Referring also to FIG. 4, in one embodiment, the paddle wheel 34 includes a paddle wheel base 50 surrounding the paddle wheel shaft 36. A plurality of paddle wheel blades 52 protrude radially outwardly from the base 50 into the cavity 32 and, thereby, into a flow path of fluid entering the cavity 32 via the inlet opening 38. In the embodiment depicted, the paddle wheel blades 52 include a generally curved profile over the majority of their extension away from the base 50, in order to effectively harvest kinetic energy from passing fluid. It will be understood, however, that other configurations are possible.

In the embodiment depicted, two types of blades 52 extend from the paddle wheel 34 and are characterized by first-type blades 60 and second-type blades 90, although other embodiments may include a different number of blade types (e.g., three or more different blade types). Similarly, the two types of blades 52 depicted may be generally viewed as similarly shaped, but differently oriented. However, other embodiments may include various blade types that are less similar in shape. Likewise, although the depicted embodiment includes six total blades 52, with three blades of each blade type, various other numbers of blades (and respective blade types) may be utilized.

As shown in FIG. 4, first-type blades 60 include curved blade portions 62 extending radially away from the paddle wheel base 50. The blade portions 62 are each defined by curved body portions 64 that extend outwardly and terminate at rounded distal tips 66 at the radially outermost end of the body portions 64. The distal tips 66 are configured to be generally thicker than the body portions 64, and may travel along inner surfaces 56 of the cavity 32 with a relatively small clearance.

Generally, the blade portions 62 of first-type blades 60 extend along the width 54 of the paddle wheel base 50 (e.g., axially along the base 50) from exterior edges 68 at a first side 70 of the base 50 toward a second, opposite side 72 of the base 50, but do not extend the entire length of the width 54 to reach the second side 72. Rather, each blade portion 62 terminates at an interior edge 74, which is spaced interiorly from the second side 72. In certain embodiments, for example, the width 76 of the blade portion 62 may be between about 30% and about 60% of the width 54 of the base 50. In this way, the blade portions 62 may provide a close clearance between the edges 68 and the surface 78 of the internal cavity 32, but a substantially larger clearance between the edges 74 and the surface 80 of the internal cavity 32.

Still referring to FIG. 4, in certain embodiments, first-type blades 60 further include elongate base portions 82, which may extend along the paddle wheel base 50 toward the second side 72 further than blade portions 62. This may, for example, provide additional area to harvest kinetic energy from passing fluid, as well as providing additional support and stability to the blade portions 62. In certain embodiments, the base portions 82 may extend across substantially all of the width of the internal cavity 32. In other embodiments, the width 76 of the blade portion 62 is about half of the width of the base portion 82. In a further embodiment, the width 76 of the blade portion 62 is about a third of the width of the base portion 82. In still a further embodiment, the width 76 of the blade portion 62 is less than half of the width of the base portion 82. As depicted in the various figures, the base portions 82 also extend radially away from the paddle wheel base 50, but to a lesser extent than the blade portions 62. In certain embodiments, the base portions 82 may include a shoulder 86, such that a part of the base portion 82 that attaches to the blade portion 62 extends farther away from the paddle wheel base 50 than does a part of the base portion 82 that does not attach to the blade portion 62. In certain embodiments, the shoulder 86 may be mirrored by a similar shoulder 88 in the paddle wheel base 50, which in turn may correspond to one or more shoulders **36*a* on paddle wheel shaft 36 (see FIG. 3). This may, for example, allow the paddle wheel base 50 to be slid fully onto the paddle wheel shaft 36 only in one direction. The base portions 82 may be formed integrally with the base 50, or may be otherwise attached to the base 50** using a variety of known attachment means.

In certain embodiments, and as depicted in the various figures, the blade portions 62 are detachable from the base portions 82 at an attachment joint 84. For example, the blade portions 62 may be attached to the base portions 82 with snap-fit or other separable attachment means at the joint 84. In this way, the blade portions 62 may be removed and reattached to allow for relatively simple repair and maintenance of the paddle wheel 34, as well as to provide customizability through the use of different numbers or orientations of blades, or the use of blade portions 62 with various profiles, thicknesses, types of tips 66, blade widths 76, and so on.

As discussed above, the paddle wheel 34 also includes one or more second-type blades 90. Each second-type blade 90 includes curved blade portions 92 extending radially away from the paddle wheel base 50. The blade portions 92 include body portions 94 that curve outwardly and terminate at distal tips 96 at the radially outermost end of the body portions 94. The distal tips 96 are configured to be generally thicker than the body portions 94, and may travel along the inner surfaces 56 of the cavity 32 with relatively small clearance.

Generally, the blade portions 92 of second-type blades 90 extend along the width 54 of the paddle wheel base 50 (e.g., axially along the base 50) from exterior edges 98 at the second side 72 of the base 50 toward a first side 70 of the base 50, but do not extend the entire length of the width 54 to reach the first side 70. Rather, each blade portion 92 terminates at an interior edge 100, which is spaced interiorly from the first side 70. In certain embodiments, for example, the width 102 of the blade portion 92 may be between about 30% and about 60% of the width 54 of the base 50. In this way, the blade portions 92 may provide a close clearance between the edges 98 and the surface 80 of the internal cavity 32, but a substantially larger clearance between the edges 100 and the surface 78 of the internal cavity 32.

Still referring to FIG. 4, in certain embodiments, second-type blades 90 further include elongate base portions 104, which may extend along the paddle wheel base 50 toward the first side 70 further than the blade portions 92. This may, for example, provide additional area to harvest kinetic energy from passing fluid, as well as providing additional support and stability to the blade portions 92. In certain embodiments, the base portions 104 may extend across substantially all of the width of the internal cavity 32. In other embodiments, the width 102 of the blade portion 92 is about half of the width of the base portion 104. In a further embodiment, the width 102 of the blade portion 92 is about a third of the width of the base portion 104. In still a further embodiment, the width 102 of the blade portion 92 is less than half of the width of the base portion 92. As depicted in the various figures, the base portions 104 also extend radially away from the paddle wheel base 50, but to a lesser extent than the blade portions 92. In certain embodiments, the base portions 104 may include a shoulder 108, such that a part of the base portion 104 that attaches to the blade portion 92 extends further away from the paddle wheel base 50 than does a part of the base portion that does not attach to the blade portion 92. In certain embodiments, the shoulder 104 may be mirrored by the shoulder 88 in the paddle wheel base 50, which in turn may correspond to one or more shoulders 36*a* on paddle wheel shaft 36 (see FIG. 3). The base portions 104 may be formed integrally with the base 50, or may be otherwise attached to the base 50 using a variety of known attachment means.

In certain embodiments, and as depicted in the various figures, the blade portions 92 are detachable from the base portions 104 at an attachment joint 106. For example, the blade portions 92 may be attached to the base portions 104 with snap-fit or other separable attachment means at a joint 106. In this way, the blade portions 92 may be removed and reattached to allow for relatively simple repair and maintenance of the paddle wheel 34, as well as to provide customizability through the of different numbers or orientations of blades, or use of the blade portions 92 with various profiles, thicknesses, types of tips 96, blade widths 102, and so on. Where the blade portions 62 and 92 are similar (e.g., as in the embodiment depicted in the various figures), this detachable configuration may sometimes allow for the manufacturing of a single type of blade portion, which may be connected to either of the base portions 62 or 82 to complete, respectively, first-type blades 60 or second-type blades 90.

As noted above, and as depicted in the various figures, first-type blades 60 and second-type blades 90 may be oriented in an alternating arrangement around the paddle wheel 34. For example, three first-type blades 60 may be provided, extending radially away from the paddle wheel base 50 in an alternating configuration with three second-type blades 92. It will be understood that various other configurations may be possible, including configurations having additional blade types, different numbers of one or both of first-type blades 60 and second-type blades 90, and so on. For example, one embodiment may include two of first-type blades 60 and three of second-type blades 90. Another embodiment may include two of first-type blades 90 and three of second-type blades 60. Still another embodiment may include two of first-type blades 60, two of second-type blades 90, and two of a third-type blade (not shown) with a different blade width (or other geometry) than first-type blades 60 and second-type blades 90. Yet another embodiment may include two or four of first-type blades 60 and two or four of second-type blades 90.

In certain embodiments, the paddle wheel base width 54 may be approximately equal to the width of the internal cavity 32. In this way, for example, where the exterior edges 68 of first-type blades 60 are generally adjacent to the side 70 of the paddle wheel base 50, the edges 68 may pass near the surface 78 of the cavity 32 with relatively small clearance, while the interior edges 74 may provide relatively large clearances with respect to the surface 80 of the cavity 32. Similarly, the exterior edges 98 of second-type blades 90 are generally adjacent to the side 72 of the paddle wheel base 50 causing the edges 98 to pass near the surface 80 of the cavity 32 with relatively small clearance, while the interior edges 100 may provide relatively large clearances with respect to the surface 78 of the cavity 32.

As noted above, the paddle wheel mechanism 12 is positioned within a fluid path of the pool cleaner 10, within the flow area provided by the internal cavity 32 so that fluid flow through the housing 30 (i.e., into the housing 30 through the inlet opening 38, across the paddle wheel 34, and out of the housing 30 through the outlet opening 14*a* causes rotation of the paddle wheel 34 and the paddle wheel shaft 36. In other words, kinetic energy of fluid flow across the paddle wheel 34 can be harvested through rotation of the paddle wheel 34 and the paddle wheel shaft 36. In certain embodiments, the paddle wheel shaft 36 may be further connected to other components of the pool cleaner, such as steering or drive systems, so that the energy harvested by the paddle wheel 34 can provide the power to operate such components.

In this light, the alternating-blade design of the paddle wheel mechanism 12 may help to prevent the paddle wheel 34 from becoming clogged or otherwise restricted by debris being carried along the noted fluid path. Conventionally, for example, a relatively large radial clearance between the distal tips 66 and 96 and the surfaces 56 of cavity 32 would be required in order to allow debris to pass through the cavity 32 without clogging or otherwise impeding the paddle wheel 34. The alternating configuration of first-type blades 60 and second-type blades 90, however, reduces (and may even remove) the need for such a large radial clearance because debris may pass through the axial clearances between the inner edges 74 and 100 and, respectively, the surfaces 78 and 80 of the housing 30.

Figure 5:
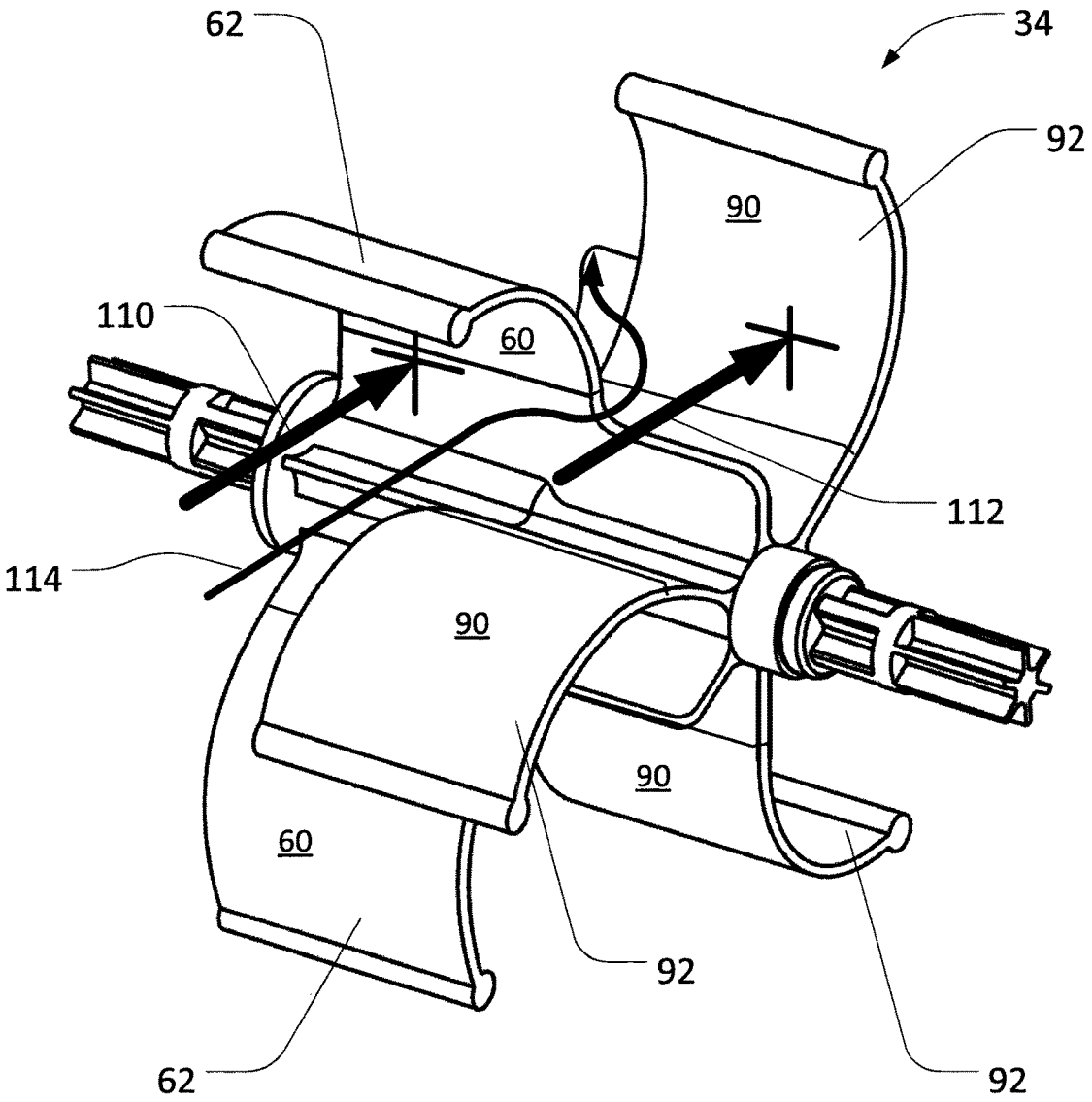
FIG. 5 is an isometric view of the paddle wheel and paddle wheel shaft of FIG. 4, with example fluid and debris paths depicted.

Referring also to FIG. 5, a portion of fluid (e.g., water) moving through the cavity 32 may travel along fluid paths 110 and 112 to impact the first-type blade 60 and the second-type blade 90 and thereby transfer a portion of its kinetic energy to the paddle wheel 34. At the same time, debris may be carried along a debris path 114 around the blade portions 62 and 92 of the blades 60 and 90 and thereby pass through and out of the cavity 32. Accordingly, as one beneficial result, the alternating-blade design of the paddle wheel mechanism 12 may provide both relatively high performance characterized by a low incidence of clogging, and relatively high efficiency.

In certain embodiments, various aspects of the geometries of first-type and second-type blades 60 and 90 (or other blade types) may be varied depending on the expected operating conditions of a particular cleaner 10. For example, the blade widths 76 and 100 may be selected based upon expected debris sizes in a particular cleaning application. Likewise, in certain embodiments (not shown), the blade portions 62 or 92 may exhibit non-uniform widths over the length of their extension away from the paddle wheel base 50. For example, the blade portion 62 may exhibit a first width at joint 84, various different widths along the body portion 64, and a different width still at the distal tip 66.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A paddle wheel mechanism for a pool cleaner, the paddle wheel mechanism comprising:

a housing with an internal flow area;

a paddle wheel shaft supported by the housing; and a paddle wheel supported by the paddle wheel shaft, the paddle wheel including a paddle wheel base extending along a base width and a plurality of paddle wheel blades extending from the paddle wheel base within the internal flow area, the plurality of paddle wheel blades including a first-type blade having a first elongate base portion with a first base portion width and a first blade portion extending outwardly from the first elongate base portion and having a first blade portion width extending from the first side of the paddle wheel, the first blade portion width being less than the first base portion width, and a second-type blade having a second elongate base portion and a second blade portion extending outwardly from the second elongate base portion and having a second blade portion width, the first blade portion width and the second blade portion width each being less than the base width, the first type blade and the second-type blade being arranged on the paddle wheel base in an alternating manner.

2. The paddle wheel mechanism of claim 1, wherein at east one of the first-type blade and the second-type blade includes a curved blade profile.

3. The paddle wheel mechanism of claim 1, wherein the plurality of paddle wheel blades includes six paddle wheel blades.

4. The paddle wheel mechanism of claim 1, wherein the housing includes a fluid path opening configured to direct fluid from a fluid path of the pool cleaner across the paddle wheel.

5. The paddle wheel mechanism of claim 1, further comprising: shaft bearings; wherein the housing includes shaft supports supporting the shaft bearings; and wherein the paddle wheel shaft is supported by the shaft bearings.

6. The paddle wheel mechanism of claim 1, wherein the first blade portion width and the second blade portion width are each between 30 percent and 60 percent of the base width.

7. The paddle wheel mechanism of claim 1, wherein a plurality of the first-type blades and a plurality of the second-type blades are arranged around a circumference of the paddle wheel base in an alternating manner.

8. The paddle wheel mechanism of claim 1, wherein the first elongate base portion extends away from the paddle wheel base to a lesser extent than the first blade portion.

9. The paddle wheel mechanism of claim 1, wherein the first blade portion of the first-type blade is removably coupled to the first elongate base portion.

10. The paddle wheel mechanism of claim 1, wherein the first blade portion of the first-type blade includes a distal tip removed from the paddle wheel base and a body portion oriented between the paddle wheel base and the distal tip, the distal tip having a greater thickness than the body portion.

11. A pool cleaner comprising:

a housing with an internal flow area; and a split paddle wheel mechanism including:

a paddle wheel shaft supported by the housing; and a paddle wheel supported by the paddle wheel shaft, the paddle wheel including a paddle wheel base extending along a base width and a plurality of paddle wheel blades extending from the paddle wheel base within the internal flow area, the plurality of paddle wheel blades including a first-type blade with a first portion having a first blade width extending along the paddle wheel base from a first side of the paddle wheel base and an elongate base portion with a width extending substantially along an entirety of the base width and a second-type blade with a second portion having a second blade width extending along the paddle wheel base from a second side of the paddle wheel base, the first blade width and the second blade width each being less than the base width, the first-type blade and the second-type blade being arranged on the paddle wheel base in an alternating manner.

12. The pool cleaner of claim 11, wherein at least one of the first-type blade and the second-type blade includes a curved blade profile.

13. The pool cleaner of claim 11, wherein the plurality of paddle wheel blades includes six paddle wheel blades.

14. The pool cleaner of claim 11, wherein the housing includes a fluid path opening configured to direct fluid from a fluid path of the pool cleaner across the paddle wheel.

15. The pool cleaner of claim 11, wherein the first, blade width and the second blade width are each between 30 percent to 60 percent of the base width.

16. The pool cleaner of claim 11, wherein a plurality of the first-type blades and a plurality of the second-type blades are arranged around a circumference of the paddle wheel base in an alternating manner.

17. The pool cleaner of claim 11, wherein the elongate base portion extends away from the paddle wheel base to a lesser extent than the first portion.

18. The pool cleaner of claim 11, wherein the first portion of the first-type blade is removably coupled to the elongate base portion.

19. The pool cleaner of claim 11, wherein the first blade portion of the first-type blade includes a distal tip removed from the paddle wheel base and a body portion oriented between the paddle wheel base and the distal tip, the distal tip having a greater thickness than the body portion.

20. A paddle wheel mechanism for a pool cleaner, the paddle wheel mechanism comprising:

a housing including an internal cavity for fluid flow;

a paddle wheel shaft supported by the housing and extending, at least in part, across the internal cavity; and a paddle wheel supported by the paddle wheel shaft, the paddle wheel being oriented within the internal cavity and including a paddle wheel base extending along a base width and a plurality of paddle wheel blades extending radially from the paddle wheel base within internal cavity, the plurality of paddle wheel blades including a base portion, with a base portion width, and a blade portion, the blade portion including a plurality of first-type blades, each with a first blade portion having a first blade width extending axially along the paddle wheel base from a first side of the internal cavity and a plurality of second-type blade, each with a second blade portion having a second blade width extending axially along the paddle wheel base from a second side of the internal cavity, the first blade width and the second blade width each being less than the base width and the base portion width, the first-type blades and the second-type blades being arranged around the paddle wheel base in an alternating manner.

* * * * *